US008388363B2

(12) United States Patent
Karlsen et al.

(10) Patent No.: US 8,388,363 B2
(45) Date of Patent: Mar. 5, 2013

(54) CONNECTOR ASSEMBLY

(75) Inventors: Jan Erik Karlsen, Kolbotn (NO); Bjorn Ivar Ladegard, Oslo (NO)

(73) Assignee: Nexans, Paris (FR)

( * ) Notice: Subject to any disclaimer, the term of this patent is extended or adjusted under 35 U.S.C. 154(b) by 666 days.

(21) Appl. No.: 12/517,083

(22) PCT Filed: Dec. 17, 2007

(86) PCT No.: PCT/IB2007/055401

§ 371 (c)(1),
(2), (4) Date: Feb. 16, 2010

(87) PCT Pub. No.: WO2008/075322

PCT Pub. Date: Jun. 26, 2008

(65) Prior Publication Data

US 2010/0144181 A1 Jun. 10, 2010

(30) Foreign Application Priority Data

Dec. 14, 2006 (NO) ..... 20065805

(51) Int. Cl.
*H01R 4/64* (2006.01)

(52) U.S. Cl. ..... 439/193

(58) Field of Classification Search ..... 439/193, 439/363

See application file for complete search history.

(56) References Cited

U.S. PATENT DOCUMENTS

| | | | | |
|---|---|---|---|---|
| 3,406,371 | A * | 10/1968 | Buckeridge | 439/363 |
| 5,215,471 | A * | 6/1993 | Reymond et al. | 439/66 |
| 5,924,741 | A * | 7/1999 | Karlsen | 285/3 |
| 6,070,623 | A * | 6/2000 | Aneas | 141/329 |
| 6,328,583 | B2 * | 12/2001 | Ness et al. | 439/193 |
| 6,463,801 | B1 * | 10/2002 | Young et al. | 73/170.32 |
| 6,688,900 | B2 * | 2/2004 | Bass et al. | 439/191 |
| 7,484,768 | B2 * | 2/2009 | Barber et al. | 285/24 |
| 7,806,187 | B2 * | 10/2010 | Lugo | 166/339 |
| 2001/0005646 | A1 | 6/2001 | Ness et al. | |
| 2007/0184683 | A1 * | 8/2007 | Barber et al. | 439/74 |
| 2010/0144181 | A1 * | 6/2010 | Karlsen et al. | 439/193 |

FOREIGN PATENT DOCUMENTS

GB 2357910 A * 4/2001

OTHER PUBLICATIONS

International Search Report dated Oct. 6, 2008.

* cited by examiner

*Primary Examiner* — James Harvey
(74) *Attorney, Agent, or Firm* — Sofer & Haroun, LLP

(57) ABSTRACT

A connector assembly for connecting and/or disconnecting an electric power cable (1) to/from a subsea pipeline (8) includes a female cone element (6), a complementary male cone element (5), and bolt tightening means (70). The tightening means (70) includes in a first stab member (7) adapted to be received in a first receptacle (16) in said female cone element (6), the first receptacle (16) has an opening facing in opposite direction of the cone (12) of the female cone element (6) for receiving the first stab member (7). A tightening bolt (7*a*) is provided in the first stab member (7) with an inner end (7*c*) of the bolt (7*a*) being adapted to engage the male cone element (5) and with an outer end (7*b*) being accessible for the connecting and/or disconnecting operations.

10 Claims, 2 Drawing Sheets

CONNECTOR ASSEMBLY

RELATED APPLICATIONS

This application is a National Phase application of PCT/IB2007/055401, filed on Dec. 17, 2007, which in turn claims the benefit of priority from Norwegian Patent Application No. 2006 5805, filed on Dec. 19, 2006, the entirety of which are incorporated herein by reference.

FIELD OF THE INVENTION

The present invention relates to a connector assembly for connecting and/or disconnecting an electric power cable to/from a subsea pipeline, as well as a corresponding method. Such connector will comprise a female cone element mounted to the pipeline surface, a complementary male cone element attached to an end of the power cable, and bolt tightening means for securing contact between the female cone element and the male cone element.

What is aimed at, is a quick and safe way to connect and disconnect an electric power cable to a pipeline by use of an ROV (remote operated vehicle—or possibly WROV—work remote operated vehicle). After connection of the cable, a current for example of about 3000 ampere, will be fed to the pipeline, in particular for DEH purposes (DEH: Direct Electrical Heating).

DESCRIPTION OF RELATED ART

GB 2357910 for such a purpose describes the use of a cone system comprising elements substantially as mentioned above, and more specifically discloses a repair concept for connecting a spare (single conductor) cable to an already installed connection plate at the pipeline. This is accomplished by using a pull-in wire through the connection plate and cutting away the pull-in wire after installation. Such a repair cable cannot be disconnected any more, i.e. this is a permanent connection which is not usable as a short-time connection since no disconnection is possible. The existing high voltage connectors are too large in size and need a large connection tool/skid to be mated.

Of primary interest in connection with the present invention is a short-time or temporary (typically for 14 days) connection of a power cable to a pipeline. The cable (usually single conductor) is to be operated from a vessel and can be both connected to and disconnected from the preinstalled connection plate on the pipeline. Such an operation will be performed by means of an ROV (or WROV), and should be as fast and simple as possible. It is to be noted that temporary heating of pipelines with a power source and cable installation from a ship as contemplated here, has not been performed before.

OBJECT AND SUMMARY OF THE INVENTION

An object of the present invention is to use an ROV (or WROV) operated stab and receptacle connection, as known in the principle per se, and incorporate a novel and specific concept with a spline cone connection mated up by use of a stab-in-bolt/rotatable element that will be tightened by the ROV (or WROV).

In a connector assembly as referred to above, the novel and specific features according to the invention are primarily characterised in that said tightening means comprises a first stab member adapted to be received in a first receptacle in said female cone element, said first receptacle has an opening facing opposite of the cone of the female cone element for receiving said first stab member, and a tightening bolt is provided in said first stab member with an inner end of the bolt being adapted to engage said male cone element and with an outer end being accessible for the connecting and/or disconnecting operations.

BRIEF DESCRIPTION OF THE DRAWINGS

The foregoing and other objects, features and advantages of the present invention will become more apparent in the following detailed description of preferred embodiments as illustrated in the accompanying drawings, of which.

DETAILED DESCRIPTION

Figure 1:
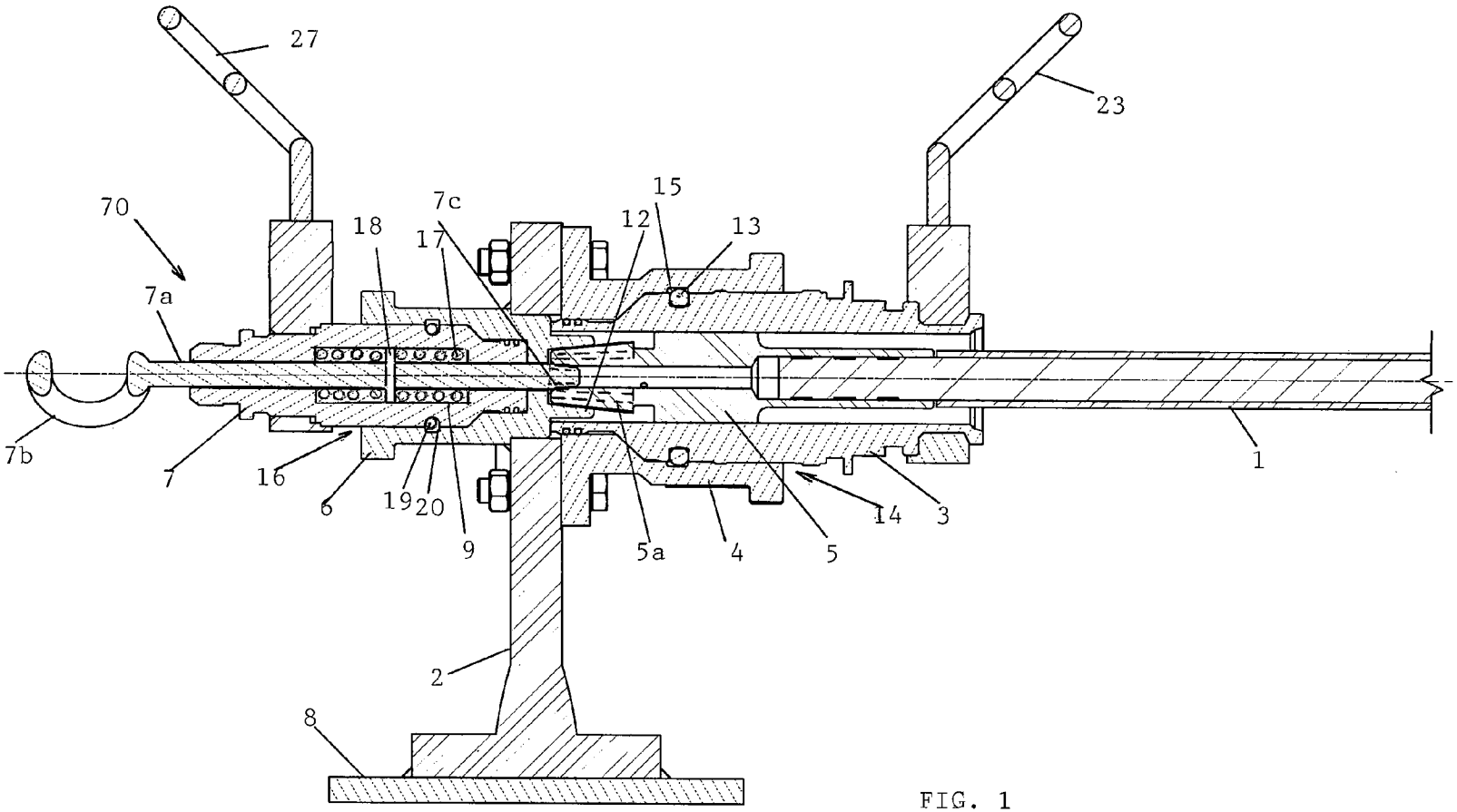
FIG. 1 in axial cross-section schematically shows a cable-to-pipeline connector assembly according an embodiment of the present invention, and FIG. 2 schematically illustrates main method steps that may be performed when establishing a connection with an assembly as shown in FIG. 1.

FIG. 1 shows an electric power cable 1, comprising for example a single core conductor, on which there is crimped an electrical male cone element 5. Around the cone element 5 there is mounted a main (or second) stab member 3 fitting into a receptacle 4 that constitutes a docking station for this stab member. Docking receptacle 4 is carried by a connection plate 2 which is welded or otherwise anchored to the surface of a pipeline 8.

In order for the stab member 3 to be securely held in receptacle 4 there is provided ball locking means with balls 13 adapted to lock into a peripheral groove 15, as known per se. However, a specific feature at this point is seen in the somewhat elongate shape of the groove 15 in the axial direction. Thus, the stab member 3 has some degree of free play in the in the length direction with respect to receptacle 4 when inserted therein.

A female cone element 6 being of complementary shape to the above male cone element 5, is provided in the form of a small receptacle welded to the connection plate 2. In the embodiment shown, female cone element/receptacle 6 extends through plate 2, whereas receptacle 4 abuts plate 2. With such a structure or relative arrangement of essential parts incorporated in the connector assembly, these parts are located very close to and are rigidly supported by the connection plate 2.

The end of the male cone element 5 has a "corrugated" contact surface 5*a* to provide a good electrical contact with the female cone element 6. Such contact improving corrugations may for example take the form of ribs on the conical surface of the male and/or female cone element.

The parts that are preinstalled (connection plate 2, docketing receptacle 4 and the small receptacle/female element 6) on the pipeline 8 are few and do not have any moveable subparts. They are designed to be easy to clean and to be protected by caps. The parts can be coated with thermal insulation in order to minimize the pipeline heat loss.

The parts that are movable in order to establish an electrical connection as explained above, are at one hand the male cone element 5 with its main (or second) stab member 3, and at the other hand tightening means for bringing about and maintaining a close electrical (and mechanical) contact between the male and female elements.

Such tightening means 70 here comprises an auxiliary (or first) stab member 7 that fits into a receptacle 16 at the outer or rear end of the female cone element 6. Centrally in stab member 7 there is provided an axial bolt 7*a* for the tightening to be effected. Thus, the inner end 7*c* of bolt 7*a* is threaded and adapted to engage internal threads at the end of male element 5. For rotating bolt 7*a* an outer end 7*b* of the bolt is accessible outside stab member 7.

As will be seen from FIG. 1, there is a central cavity 9 formed in the first stab member 7, accommodating a compression spring 17 that serves to give bolt 7*a*, with a stopper element 18, some degree of resiliency lengthwise. This is in order for the inner bolt end 7*c*, in particular, to be less vulnerable to impact and damage during installation, before being threadedly engaged with the male cone element 5.

Like the second stab member 3 also the first stab member 7 has a ball locking mechanism 19/20 so as to allow for some free play in relation to female receptacle 6 before tightening as described above. Each of the stab members 3 and 7 has a ROV handle 23 and 27, respectively.

Usually the male cone element 5 will be made of copper and the female cone element 6 of steel. This choice of materials is primarily in view of the subsea environment affecting the structures concerned. Reliability is very important, in particular with respect to the structural parts being preinstalled on the pipeline; an approximate design life of about 50 years at water depths roughly from around 550 meters to around 850 meters may be aimed at in a practical installation.

Figure 2:
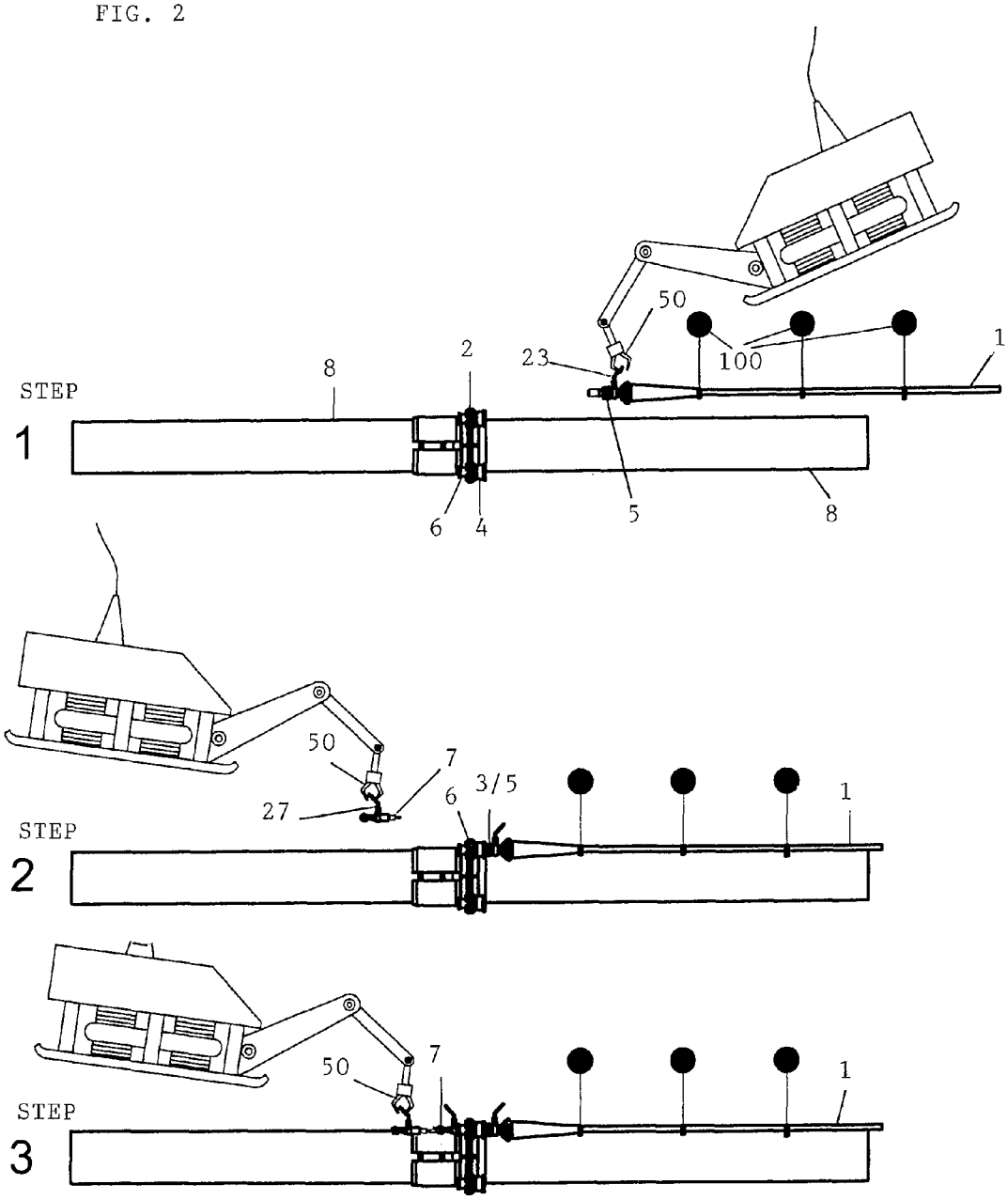

For illustrating method steps when installing an electric cable 1 at a pipeline 8, reference is made to FIG. 2.

STEP 1: An ROV or WROV with its manipulator arm and claw tool 50 takes up male cone element 5 with stab member 3, having been lowered together with the connected cable 1, from a supply vessel (not shown) to the seabed close to the pipeline 8 and its connecting plate 2. The end of cable 1 with stab member 3 is being held above the seabed by means of buoyancy modules 100 attached to the cable. From this position the ROV or WROV guides the male cone/stab 5/3 into the receptacle 4 on the connection plate 2. Here the stab is self-locking in the receptacle as described above, by locking means 13/15.

STEP 2: The same (or another) ROV (or WROV) then by means of handle 27 picks up the other stab member 7 with the tightening means 70 and inserts it in the receptacle 16 formed in the female cone element 6, from the opposite side in relation to cone 12 and with a self-locking function 19/20 so as to temporarily keep the parts assembled.

STEP 3: Finally, in order to establish a secure contact between the male and female cones, the same (or another) ROV (or WROV) with its tool 50 or possibly a special tool engaging outer bolt end 7*b*, will rotate the bolt 7*a* to screw the same into the end of the male cone 5, thereby pulling the two parts together, into the position shown in FIG. 1.

For removing an electrical connection established according to method steps as described above, the ROV (or WROV) in a position corresponding to STEP 3 in FIG. 2, should unscrew bolt element 7*a* in order to disconnect the female and male cones 6 and 5. In this operation it is to be recalled that cone/stab 5/3 has a free play in the length direction related to receptacle 4, thus making it easier to free the cones.

From a position corresponding to STEP 1 in FIG. 2, the ROV (or WROV) can then pull out cone/stab 5, 3 and cable 1. The ROV (or WROV) can also use high torque in order to disconnect the cones. In general it will be understood that a disconnect operation will be effected in a reverse sequence of steps compared to connecting STEPS 1, 2 and 3 described above.

In the context of direct electric heating (DEH) it is a normal procedure to provide for a similar connect/disconnect ROV operation at an opposite end of the DEH cable at a remote point on the pipeline.

The present invention provides advantageous solutions for temporary heating of pipelines where the DEH cable is to be disconnected after use. Using the ROV or WROV operated stab/receptacle solution together with a new design of electrical cone elements/tightening means represents a new concept for quick connection/disconnection of power cables to pipelines.

The invention claimed is:

1. Connector assembly for connecting and/or disconnecting an electric power cable ROM to/from a subsea pipeline, in particular for direct electric heating thereof, comprising:

a female cone element mounted to the pipeline surface;

a complementary male cone element attached to an end of the power cable; and bolt tightening means for securing contact between the female cone element and the male cone element, wherein said tightening means includes a first stab member adapted to be received in a first receptacle in said female cone element, said first receptacle has an opening facing in opposite direction of the cone of the female cone element for receiving said first stab member, and a tightening bolt is provided in said first stab member with an inner end of the bolt being adapted to engage said male cone element and with an outer end being accessible for the connecting and/or disconnecting operations.

2. Assembly according to claim 1, wherein said first receptacle is coaxial with the cone of the female cone element, and the tightening bolt is located centrally in said first stab member.

3. Assembly according to claim 1, wherein a threaded portion of said tightening bolt is adapted to engage corresponding threads in the male cone element.

4. Assembly according to claim 1, wherein a central cavity in said first stab member contains an axial compression spring cooperating with a stopper element on a middle portion of said tightening bolt, so as to provide a degree of resiliency of the bolt in the axial direction.

5. Assembly according to claim 1, wherein a second stab member is mounted on said male cone element and is adapted to be received in a second receptacle rigidly connected to the pipeline.

6. Assembly according to claim 1, wherein said first and/or second stab member(s) is/are provided with ball locking means with ball grooves having a certain extension in the axial direction of said stab member(s) so as to allow for some resilient free play of the stab member(s) axially when inserted into the corresponding receptacle(s).

7. Assembly according to claim 1, wherein a contact surface at the inner end of said male cone element is provided with ribs or corrugations for improving the electric contact to be secured.

8. Assembly according to claim 1, wherein said first and second stab members are provided with ROV (WROV) handles for cooperation with said ROV or WROV.

9. Method for connecting an electric power cable to a subsea pipeline employing a connector assembly having a female cone element mounted to the pipeline surface, a complementary male cone element attached to an end of the power cable, and bolt tightening means for securing contact between the female cone element and the male cone element, said method comprising the steps of:

an ROV or WROV grips a main (or second) stab member incorporating said male cone element, and inserts the male cone element into the cone of said female cone element, an ROV or WROV grips an auxiliary (or first) stab member made from said tightening means, and inserts the auxiliary stab member into a receptacle in said female cone element opposite of said cone of the female cone element, and an ROV or WROV operates said tightening means so as to secure contact between the female cone element and the male cone element.

10. Method according to claim 9, wherein all said steps are performed by one and the same ROV or WROV.

* * * * *

UNITED STATES PATENT AND TRADEMARK OFFICE

CERTIFICATE OF CORRECTION

PATENT NO. : 8,388,363 B2
APPLICATION NO. : 12/517083
DATED : February 26, 2013
INVENTOR(S) : Karlsen et al.

It is certified that error appears in the above-identified patent and that said Letters Patent is hereby corrected as shown below:

In the Claims

Column 4, Claim 1, Line 14: the word "ROM" should be deleted

Signed and Sealed this
Twenty-eighth Day of May, 2013

Teresa Stanek Rea
*Acting Director of the United States Patent and Trademark Office*